US012152579B2

(12) United States Patent
Husøy et al.

(10) Patent No.: US 12,152,579 B2
(45) Date of Patent: Nov. 26, 2024

(54) CONTROL, TIMING, POSITIONING, AND MODULATION OF PISTONS IN HIGH-PRESSURE FLUID ENDS

(71) Applicant: IMPACT SOLUTIONS AS, Ulsteinvik (NO)

(72) Inventors: Oddgeir Husøy, Fosnavaag (NO); Paul George, Denver, CO (US)

(73) Assignee: Impact Solutions AS, Ulsteinvik (NO)

( * ) Notice: Subject to any disclaimer, the term of this patent is extended or adjusted under 35 U.S.C. 154(b) by 181 days.

(21) Appl. No.: 16/592,153

(22) Filed: Oct. 3, 2019

(65) Prior Publication Data

US 2020/0109610 A1 Apr. 9, 2020

Related U.S. Application Data

(60) Provisional application No. 62/740,774, filed on Oct. 3, 2018.

(51) Int. Cl.
*F04B 49/06* (2006.01)
*F04B 47/04* (2006.01)

(52) U.S. Cl.
CPC ..... *F04B 49/065* (2013.01); *F04B 47/04* (2013.01); *F04B 2201/0201* (2013.01); *F04B 2201/0202* (2013.01); *F04B 2205/04* (2013.01)

(58) Field of Classification Search
CPC ..... F04B 9/1172; F04B 9/1174; F04B 9/1176; F04B 9/1178; F04B 9/109; F04B 9/105; F04B 49/065; F04B 2201/0201; F04B 2201/0202; F04B 2201/2205; F04B 2201/04; E21B 43/2607; E21B 43/26; F15B 15/2807
See application file for complete search history.

(56) References Cited

U.S. PATENT DOCUMENTS 5,281,100 A * 1/1994 Diederich ..... E21B 43/127 417/18
5,846,056 A 12/1998 Dhindsa et al.
10,436,766 B1 * 10/2019 Bayyouk ..... E21B 43/26
2006/0266211 A1 * 11/2006 Larkin ..... F04B 1/2014 92/5 R
2011/0318195 A1 12/2011 Cardelius et al.
(Continued)

FOREIGN PATENT DOCUMENTS

DE 10027407 A1 12/2001

OTHER PUBLICATIONS

PCT Application No. PCT/IB2019/058443, International Search Report and Written Opinion, dated Nov. 27, 2019, 13 pages.

*Primary Examiner* — Nathan C Zollinger
(74) *Attorney, Agent, or Firm* — AVEK IP, LLC

(57) ABSTRACT

An automatically controlled hydraulic fracturing pump system includes a hydraulic cylinder controlled via a hydraulic circuit; a sensor in communication with the hydraulic circuit; and a control module in data communication with the sensor. The control module has a memory storing computer-readable instructions; and a processor configured to execute said instructions to: (1) determine, via the sensor, an attribute about the hydraulic cylinder; (2) determine an attribute about the hydraulic fracturing pump system; (3) determine a value for correcting movement of the hydraulic cylinder; and (4) send a signal to the hydraulic circuit to adjust movement of the hydraulic cylinder.

17 Claims, 5 Drawing Sheets

(56) References Cited

U.S. PATENT DOCUMENTS

| | | | | |
|---|---|---|---|---|
| 2015/0192117 | A1* | 7/2015 | Bridges | F04B 17/05 417/53 |
| 2017/0090457 | A1 | 3/2017 | Pandurangan et al. | |
| 2017/0211569 | A1* | 7/2017 | Urdaneta | F04B 49/065 |
| 2018/0030978 | A1* | 2/2018 | McCarthy | F04B 35/00 |
| 2018/0266412 | A1* | 9/2018 | Stokkev g | F04B 49/08 |
| 2019/0331100 | A1* | 10/2019 | Gable | F04B 11/005 |

* cited by examiner

CONTROL, TIMING, POSITIONING, AND MODULATION OF PISTONS IN HIGH-PRESSURE FLUID ENDS

CROSS-REFERENCE TO RELATED APPLICATIONS

This application claims priority to U.S. Provisional Patent Application No. 62/740,774, filed Oct. 3, 2018, the disclosure of which is incorporated by reference herein in its entirety.

FIELD OF THE INVENTION

The invention relates generally to the control, timing, and positioning of reciprocating pistons used to power and drive high-pressure fluid pumps.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to one embodiment, an automatically controlled hydraulic fracturing pump system includes a hydraulic cylinder controlled via a hydraulic circuit; a sensor in communication with the hydraulic circuit; and a control module in data communication with the sensor. The control module has a memory storing computer-readable instructions; and a processor configured to execute the instructions to: (1) determine, via the sensor, an attribute about the hydraulic cylinder; (2) determine an attribute about the hydraulic fracturing pump system; (3) determine a value for correcting the movement of the hydraulic cylinder; and (4) send a signal to the hydraulic circuit to correct movement of the hydraulic cylinder based on the value.

According to another embodiment, an automatically controlled hydraulic fracturing pump system has a first hydraulic cylinder having a piston controlled via a first hydraulic circuit; a second hydraulic cylinder having a piston controlled via a second hydraulic circuit; a first sensor in communication with the first hydraulic circuit; a second sensor in communication with the second hydraulic circuit; and a control module in data communication with each sensor. The control module includes a memory storing computer-readable instructions; and a processor configured to execute said instructions to: (1) determine an attribute about the first hydraulic cylinder piston via the first sensor; (2) determine an attribute about the second hydraulic cylinder piston via the second sensor; (3) determine an attribute about the hydraulic fracturing pump system; (4) determine a first value for correcting movement of the first hydraulic cylinder piston; (5) determine a second value for correcting movement of the second hydraulic cylinder piston; (6) send a signal to the first hydraulic circuit to correct movement of the first hydraulic cylinder piston based on the first value; and (7) send a signal to the second hydraulic circuit to correct movement of the second hydraulic cylinder piston based on the second value.

In still another embodiment, an automatically controlled hydraulic fracturing pump system for a hydraulic fracturing pump job has a hydraulic cylinder controlled via a hydraulic circuit; a sensor in communication with the hydraulic circuit; and a control module in data communication with the sensor. The control module includes a memory storing computer-readable instructions; and a processor configured to execute said instructions to: (1) receive operating parameters from a user via an input device; (2) access historical operation data stored in a database stored in the memory; (3) determine a predicted cylinder movement based on the operating parameters and the historical operation data; (4) initiate movement of the hydraulic cylinder; (5) determine, via the sensor, an attribute about the movement of the hydraulic cylinder; (6) determine an attribute about the hydraulic fracturing pump system; (7) compare the attribute of the hydraulic fracturing pump system with the operating parameters; (8) determine a value for correcting movement of the hydraulic cylinder; (9) send a signal to the hydraulic circuit to correct movement of the hydraulic cylinder based on the value; (10) determine an actual corrected movement of the hydraulic cylinder via the sensor; (11) update the historical operation data with the actual adjusted movement; and (12) repeat steps 5 through 11 until the hydraulic fracturing pump job is complete.

In still another embodiment, an automatically controlled hydraulic fracturing pump system for a hydraulic fracturing pump job has a dual acting hydraulic cylinder controlled via a hydraulic circuit; a sensor in communication with the hydraulic circuit; and a control module in data communication with the sensor. The dual acting hydraulic cylinder is capable of acting to pressurize well fluids in both directions. It is operably connected to opposing fluid ends, and while one fluid end cylinder is filling with fracking fluids and recharging to get ready for pressurization, the other fluid end cylinder is pressurizing and pumping well fluids.

DETAILED DESCRIPTION

Figure 1:
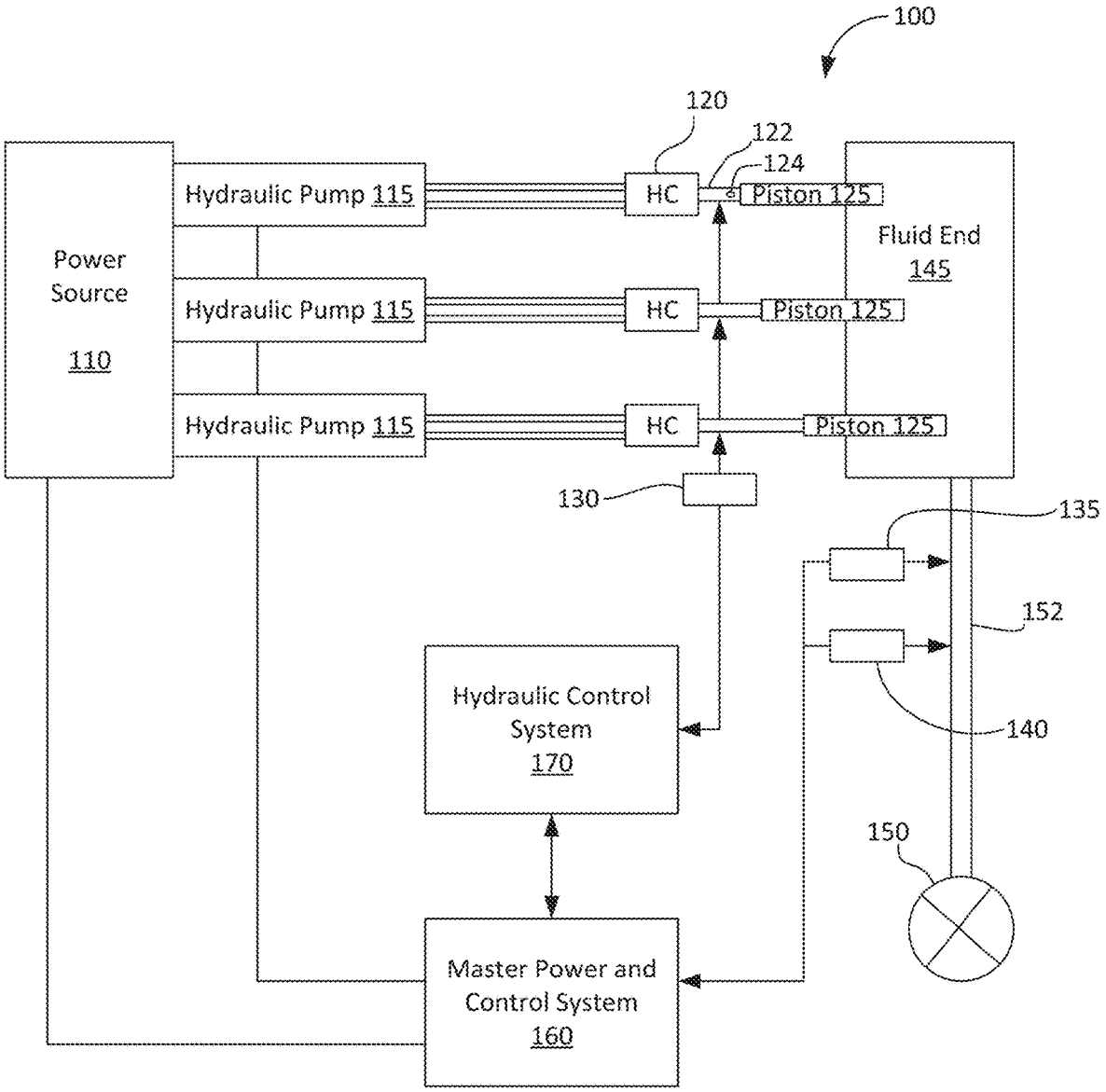
FIG. 1 is a schematic illustration of a hydraulic fracturing system incorporating a control module according to an embodiment of the invention.

In hydraulic fracturing operations, fluids are commonly referred to as slurries or fracturing fluids, and are typically mixtures of chemicals, water, hydrocarbons, and proppants (solids). The slurries are often mixed in blenders prior to pressurization, and are abrasive, erosive, and corrosive in nature.

Hydraulic fracturing pump systems were developed for the purpose of pumping such fluids, and include a power system and a fluid end. The power system typically includes an engine (for example, a diesel or other reciprocating engine, an electric motor, a gas turbine, et cetera), a transmission, and a power end. The power end includes a crankshaft, reduction gears, bearings, connecting rods, crossheads, crosshead extension rods, and other elements to convert rotational energy from the engine to reciprocating energy. The fluid end is typically, though not necessarily, a reciprocating high-pressure pump that is driven by reciprocating motion from the power system (and specifically the power end).

Some systems incorporate computerized hydraulic controls, hydraulic pumps, and hydraulic cylinders to replace the traditional transmission and power end. These hydraulic components convert rotational energy to reciprocating energy for driving a high-pressure pump. In a hydraulic system, the engine is mechanically connected to a gearbox, which is connected to hydraulic pumps, which is in turn hydraulically connected to the hydraulic cylinders which drive some form of high-pressure reciprocating pump (fluid end).

Typical fluid end assemblies usually include a housing such as a machined steel block that has a plurality of suction bores, discharge bores, access ports, plunger bores, high-pressure seals, and retainers, among other elements. Each suction bore has a suction valve and a seat, and likewise, each discharge bore has a discharge valve and a seat. Each plunger bore has a plunger (i.e., piston) and a packing seal assembly. As is described in greater detail below, the various valves, seals, and plungers control the flow of fracking fluids entering and leaving the fluid end housing from the low-pressure side and the high-pressure side, respectively.

In operation, the fluid end receives the low-pressure slurry at an entrance via a low-pressure manifold where it enters a central cylinder to pressurize the fluid to a very high-pressure and high flow rate. Typically, the low-pressure intake manifolds of multiple hydraulic fracturing pumps are connected together using low-pressure fluid delivery systems (i.e., low-pressure manifolds), which distribute flow to each of the high-pressure pumps from the blending systems.

The fluid end typically has multiple inner chambers (or "cylinders") arranged side-by-side to form triplex or quintuplex pumps. A reciprocating piston acts in each chamber to pressurize the fluid. The reciprocating pistons in the fluid ends typically run at speeds in the order of 150-200 strokes per minute.

High-pressure discharge manifolds of multiple hydraulic fracturing pumps are often connected together using high-pressure fluid delivery systems (high-pressure manifolds), which aggregate the flow from each of the high-pressure pumps, and direct it into the wellhead, and down the well bore to the formations in order to hydraulically fracture them.

Operating fracking fluid pressure often varies between 0-10,000 psi and can be up to, for example, 15,000 psi. The cyclic nature, high-pressure, and high fluid rates combined with the harsh characteristics of the fracking slurry result in the operating equipment being subjected to a high stress operating environment. The interactions between the mechanical systems at surface, the high-pressure fluid delivery systems, the well bore, and the downhole formations are complex.

Safety relief systems are installed on the fluid ends, and in the fluid conduits, to allow fluid bypass should an over pressure event occur. More particularly, high-pressure relief valves may be mounted externally on the high-pressure fluid side of the fluid end to relieve fracturing fluid pressure and volume to atmospheric conditions if an over-pressure event occurs. Typically, such systems include mechanical valves, such as mechanical pop off or burst disc valves. Some newer computer assisted systems are available, but in principle, the valves still mechanically release and vent fracturing fluids to atmospheric pressures.

In addition to the intense operating pressures, the system is further challenged as a result of physical movement of the system components. Many types of vibrational waves (e.g., acoustic, pressure, etc.) are experienced in the surface equipment, high-pressure fluid delivery systems, and even the low-pressure fluid delivery systems. The vibrational waves are generated by, and are inherent due to reciprocating pump design. The process of pressurizing a fluid—e.g., the opening and closing of suction and discharge valve assemblies, cylinder filling, and cyclic pressurization and depressurization of the fluid—guarantees the presence of vibrational waves in the system. The vibrational waves can occur at various amplitudes and frequencies, and produce different resonant and harmonic effects. The vibrations interact, combine, and consequentially produce energy pulses that can be constructive and/or destructive in nature. These issues may be compounded when multiple pumps run independently and separately from each other.

There are currently very few methods utilized in existing traditional hydraulic fracturing systems to control, reduce, modulate, or optimize these vibrations in an effective manner. Occasionally, general mechanical forms of wave dampeners or wave blockers are deployed in the conduits to absorb or inhibit wave propagation. Some systems incorporate means for monitoring the forces (e.g., sensors), and then human action is taken to minimize or reduce forces such as changing transmission gear, or modifying the engine RPM. This is done in order to try to minimize the vibration affects. In all cases, the actions modify how a power end and fluid end act as a unit entity. By adjusting the engine rpm or transmission gear it is possible to modulate the rotational speed of the drive system, which alters the reciprocating speed of the all cylinders in an entire pump. However, there is no ability to modify or control the individual piston, or adjust the individual piston motion with respect to any other piston motion.

Currently, sensors installed in the fluid ends and/or power ends measure parameters such as shaft rotation, stroke counts, temperatures, oil pressures, vibration, and/or pressure. While these sensors provide relevant and useful data about the system, the sensors are generally ancillary in nature, attached using secondary mechanisms, and are not generally well integrated or embedded into, or part of the fluid end, or power drive system. As such, they do not specifically measure, calculate, or assess the position of the reciprocating pistons or shafts, and the sensor data is not used to automatically modify the timing of individual pumps, the timing of individual cylinders, or to modify other characteristics of individual pistons in the fluid end.

Thus, there is a lack of fully integrated monitoring and control systems for measuring, calculating, processing, and assessing such parameters as individual piston or shaft stroke rate, stroke length, speed, acceleration, deceleration, stopping point, point of reversal, power and energy applied, or assessing the relationship of individual piston movement to valve and fluid movements, or to each other. A system utilizing measurable data from sensors distributed throughout the system to control operation of the system would be useful.

Embodiments of hydraulic fracturing control systems and methods for operating, controlling, and modulating individual piston movements of a hydraulically powered fluid end are described herein. As is described in greater detail herein, the invention may provide micro control, instantaneous correction, and an ability to synchronize and adjust all pistons of a hydraulic pump system as a unified whole. The invention may further provide for very precise control of the speed, stop, start, reversal, acceleration, deceleration, etc., to very high degree of precision, and at very high speeds, of all the pistons of a hydraulic pump system as a unified whole.

According to one embodiment of the invention, embedded, imprinted, or laser etched markings are disposed on each of the reciprocating members (pistons) in the form of a precise grid or code. A sensor pickup is installed on the piston housing that is capable of reading the markings. The data is sent to a computer algorithm (programming) which interprets the sensor signals and translates the signals into accurate measures of movement and position. Rates, speed, and acceleration can be integrated at any point of time, and this information can be related to the precise state of movement to high degrees of accuracy. This information may then be used by other control systems to modulate and adjust system operation, and individual cylinder performance.

The etchings may be placed along the longitudinal axis of the piston or cylinder shaft. Generally, the etchings are installed on the face of the shaft in such a way that they do not interfere with the performance of the reciprocating cylinders or hydraulics, yet enable the production of signal feedback indicating shaft position. The sensor (for example an optical, laser, potentiometer, or magnetic reader) is installed in a position such that it can determine movement of the reciprocating shaft via reading the etched markings.

The physical positional measurements (e.g., positional data) of the cylinders may be utilized by the programming to alter the position of the individual cylinder shafts based on other data from the system, including hydraulic cyclic performance modulation data, calibration data, rates (e.g., fluid flow rates), time data, volume data, pressure data, etc. and algorithms mathematically model domains (pressure, length, stroke, amplitude, frequency, speed, acceleration, etc.) from the system data in order to generate highly accurate positional control signals. Each domain may be mathematically optimized individually, and as a unit of cylinders, in order to generate an output signal and to change characteristics of one or more of the cylinders. In operation, each individual cylinder may be adjusted in order to tune the dynamic forces of the system to improve the efficiency of the system and prevent destructive interference patterns. The programming may be configured to control acceleration, deceleration, stoppage, start, power adjustment, and/or to generally manage the movement of one or more individual cylinders in relationship to any other individual cylinder or group of cylinders. If the pistons are operated incorrectly, it can result in an individual piston, or multiples of pistons catastrophically contacting the end walls of the containing mechanisms, and failing.

In an embodiment, the programming uses feedback received from sensitive high frequency sensors mounted in the hydraulic system, the high-pressure delivery system, and in the low-pressure delivery system, to alter the movement of the cylinders to prevent unsafe pressure build-up and/or to avoid failure of system components due to unwanted vibrations within the system. By modulating movement of individual cylinders, the programming may introduce pulsation events that offset, smooth out, or even eliminate the destructive vibrations inherently present in the system. The result is a much smoother operating system that reduces the overall stress and peak forces that may cause premature failure of various components of the system.

FIG. 1 is a schematic illustration of a hydraulic fracturing system 100 of the invention. As described above, the system 100 includes a power source 110 (e.g., an engine and/or a gear box). The power source 110 is operatively coupled to one or more hydraulic pumps 115, each of which is functionally linked to a hydraulic cylinder 120 having a piston 125. The hydraulic cylinder receives hydraulic fluid from the hydraulic pump 115 to alter the position of the piston 125. Subsequently, the spent hydraulic fluid returns to the pump 115 via hydraulic line 119. The pistons 125 charge the fluid in the fluid end 145, which is sent to the wellhead 150 via a high-pressure conduit 152. The conduit 152 may have one or more sensors distributed along its length (e.g., inside or outside of the conduit 152) for measuring pressure 135 and/or vibration 140. Moreover, one or more position sensors 130 may be located at each hydraulic cylinder 120 for determining the location and timing of each piston 125.

A master power and control system 160 controls the power source 110 and the hydraulic pumps 115, which may be based on output pressures in the high-pressure conduit 152. A hydraulic control system 170 is equipped with an algorithm 185 that processes information for the purpose of controlling and modulating the timing and/or positioning of the pistons 125. The information received by the various sensors 130, 135, and 140 is communicated to the hydraulic control system 170 and/or the master power control system 160, and the control systems 160 and 170 may exchange information for the purpose of controlling the components of the system 100.

Figure 2:
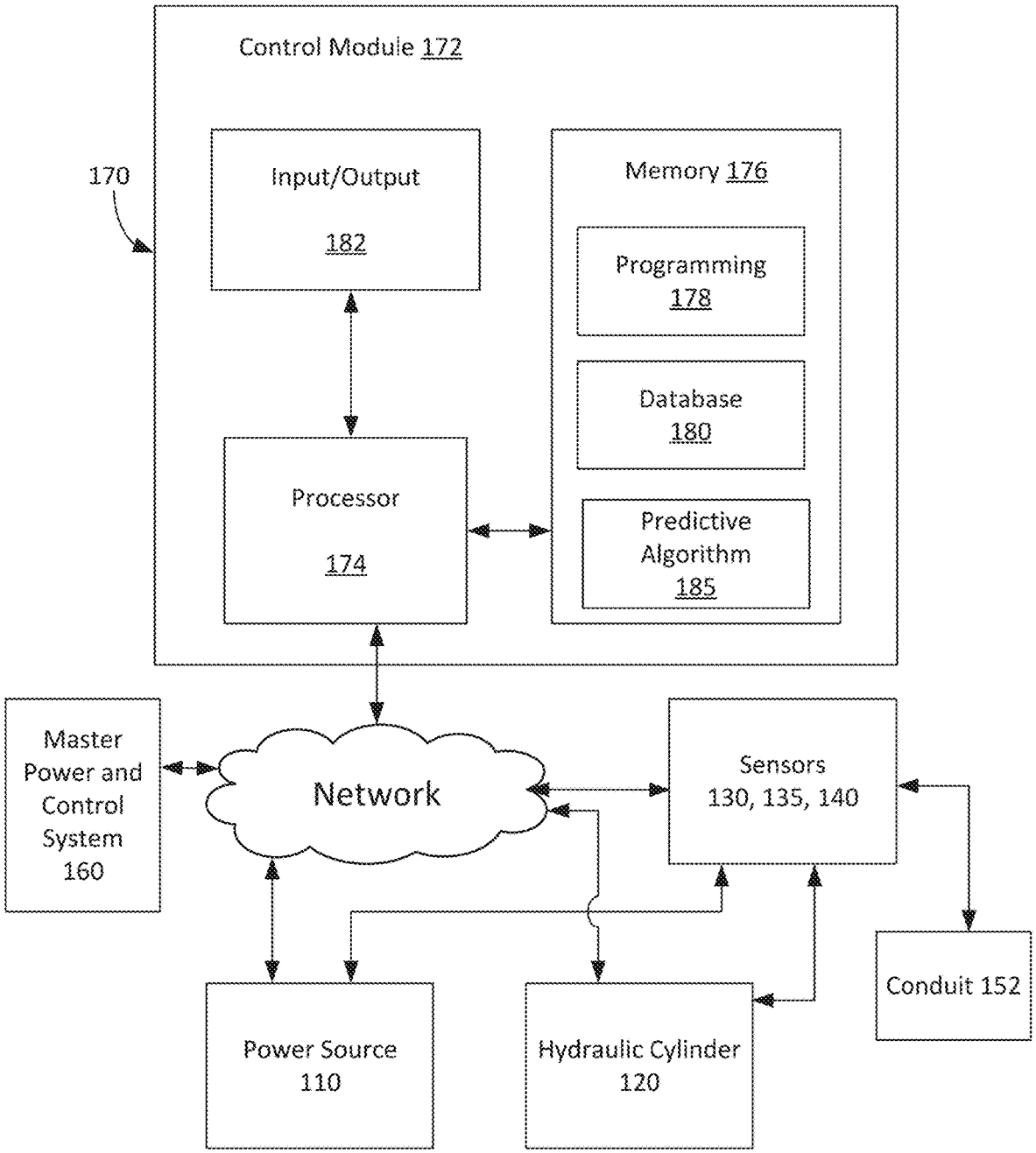
FIG. 2 is a schematic illustration of the control module according to an embodiment of the invention.

Referring now to FIG. 2, the hydraulic control system 170 comprises a control module 172 in communication with hydraulic circuits for managing the movement of the hydraulic cylinders 120 within the fluid end 145. The artisan understands that the control module 172 may comprise a processor 174 and a memory 176 housing one or more algorithms 178, 185 that allow for managing the movement and position of individual pistons 125. Importantly, each hydraulic drive cylinder 120 may be run independent of the others using separate hydraulic circuits. In an embodiment, the control system 170 manages a plurality of hydraulic motors and hydraulic cylinders 120.

As with traditional systems, several hydraulic cylinders 120 may also be combined and packaged in different orientations to drive the fluid end 145. For example, hydraulic cylinders 120 may be combined in triplex or quintuplex form to drive traditionally oriented fluid ends. Other combinations are also possible, such as a six-pack configuration with two opposing fluid ends connected together with three hydraulic cylinders.

The processor 174 may be any suitable processor, such as a microprocessor, a co-processor, etc. The control module 172 may further include one or more input/output devices 182, which may comprise any suitable input and/or output device, such as a display, a speaker, one or more sensors, etc., for allowing the module, and/or users of the module, to interact with other components of the hydraulic fracturing system 100.

The memory 176 may be transitory memory, non-transitory memory, or a combination thereof. In embodiments, the memory 176 may include a control algorithm 178. The control algorithm 178 may be stored in a transitory and/or a non-transitory portion of the memory 176. The control algorithm 178 is software and/or firmware that contains machine-readable instructions executed by the processor 174 to perform the functionality of the system as described herein.

The processor 174 of the control module 172 may be in communication (e.g., over a network 190, such as a wireless network) with one or more sensors 130, 135, 140 configured to provide sensor data, including but not limited to location of one or more pistons 125, pressure within the system 100

(e.g., at a particular location), flow rate through a conduit 152, etc. As noted herein, according to one embodiment of the invention, a hydraulic piston shaft 122 may be laser etched to contain computer readable markings 124. The marking 124 may be, for example, a grid or code etched onto the piston shaft 122. In some embodiments, the marking 124 may be etched onto the piston surface. A sensor 130 (e.g., optical sensor) may be installed at the piston housing 125 which is configured to read the marking 124 and provide information to the algorithm 178 to adjust and control the position of the piston 125. The sensor 130 reads the movement of the markings 124, and the data is then processed by the algorithm 178 to very accurately determine the position of the individual piston 125. In addition to the position of the piston 125, the sensor 130 may be configured to provide data related to the rate of movement of the piston 125.

The laser etched marking 124 and the processing of data may be used in conjunction with other systems which may back up or provide other relative position indicators and/or sensors for providing additional data about the cylinders and/or the overall system 100. For example, displacement sensors, potentiometers, and/or trip sensors may be utilized to determine precise position of the pistons 125. Accelerometers may measure acceleration and deceleration of the pistons 125. Speedometers may measure the speed of the piston 125. Pressure sensors may determine pressure in the cylinder 120, and specifically the pressure of the fluid leaving the fluid end 145. The speed of the hydraulic pump 115 may be recorded for use by the system 100. Volume sensors such as flow meters may record the volume of fluids pumped through the system 100. Together, these system characteristics may be utilized to accurately determine and control piston 125 movement.

The individual data from each hydraulic cylinder 120 is important; however, in order to achieve ideal fracturing pump operation, and to modulate the forces produced in the system, the forces applied, rate, acceleration, decelerations, position and timing of each individual hydraulic cylinder 120 and piston 125 must be compared relative the other hydraulic cylinders 120 and pistons 125 forming the system 100. Further, it shall be understood by those of skill in the art that a single hydraulic cylinder 120, or a group of hydraulic cylinders 120, may be individually controlled via the control module 172. This is possible because data is retrieved from each cylinder 120 and/or piston 125, and each cylinder 120 (or group of cylinders 120) may be independently controlled with a hydraulic circuit. Ideally, the control system 172 balances, matches, and times the motion of, for example, three individual hydraulic drive cylinders 120 to optimize the performance of a triplex fracturing pump 115; a group of individual hydraulic drive cylinders 120 to optimize the performance of several fracturing pumps 115; and/or all individual hydraulic drive cylinders 120 to optimize the performance of the fracturing system 100 as a whole.

Data from the various sensors 130, 135, 140 may be stored in a database 180, which may (but need not be) housed in the memory 176. The algorithm 178, via the processor 174, accesses the data from the sensors 130, 135, and/or 140 in order to control movement of the pistons 125, and therefore movement of fluid through the system 100. Specifically, the algorithm 178 is configured to analyze the data in order to control the force, rate, acceleration, deceleration, stop position, and direction of movement of each piston 125. Because each cylinder 120 (or group of cylinders 120) has a separate hydraulic circuit, the force exerted on the fluids can be modulated by changing the hydraulic outputs to the hydraulic cylinder 120. The algorithm 178 may be applied in a looping pattern such that movement of the piston 125 is altered in real time according to the real-time data from the sensors 130, 135, and/or 140.

The algorithm 178 may be further configured to provide predicted motion based on current and/or historical sensor data. The current and/or historical sensor data can further allow the algorithm 178 to provide calculated motions of one or more pistons 125. This may be accomplished by developing a model of the pattern of movement of the pistons 125 as a function of historical data and/or current positional information from the sensors 130. Based on the model, it may be possible to predict rate and displacement calculations for each piston 125, or the exact time and location that each piston 125 should stop and reverse direction. For example, exact rate and displacement calculations can be made based on movement of the pistons 125 determined from the motion sensors 130. This information can be compared to the measured motions in real time to calibrate the system 100 and inform future predicted and calculated motions. Still further, the algorithm 178 may be configured to complete Checksum error calculations on each stroke to validate movement and sense errors and provide correction as needed.

Importantly, a predictive algorithm 185 can use the historical data and the model to determine the exact time and location to stop the piston 125 and initiate movement of the piston 125 in the opposite direction, while taking into account the inertia, or "spring effect" associated with the movement of the piston 125. In other words, various system effects combined with the forward momentum of the piston 125 may prevent the piston 125 from stopping immediately and reversing course, even after the hydraulics to the cylinder 120 are stopped (time=0). Rather, at time=0, the piston 125 continues its forward movement for a time and distance which is dependent on the speed, acceleration, materials, and fluid compressibility etc. of the system 100. To compensate for this spring effect, the predictive algorithm 185 may impart a corrective pressure on the piston 125, effectively acting to reverse the piston motion before it stops, and to cause the piston 125 to stop at the exact location needed to maximize the function of the system 100. Movement of a piston 125 occurs within three regions—an acceleration region, a speed region, and a deceleration/turn region. In operation, it is preferred that the piston 125 spends the majority of the time in the speed region, as the rate of production is a direct function of the speed of the piston 125. Therefore, the piston 125 is accelerated as quickly as possible to speed, and decelerated as quickly as possible such that the piston 125 can reverse course and return to speed. Accordingly, by compensating for the time (and distance) it takes for the piston 125 to completely decelerate and reverse course, the predictive algorithm 185 optimizes the efficiency of the cylinder 120 by maximizing the time that the piston 125 operates at speed. The piston 125 movement can also be adjusted or compensated based on valve performance. The hydraulic cylinder pressure responses are a function of valve performance and the motion of the piston 125. This is incorporated into the models and predictive algorithms 185, and hence the movement of the piston 125 in the fluid end 145 acting in conjunction with the opening and closing of valves in the fluid end 145 can be modulated to achieve optimal performance of the system 100.

The master power and control system 160 may be similar to the hydraulic control system 170. The master power and control system 160 may include a control module having a processor, an input/output device, and memory storing programming for effectuating the function of the system 100. The programming may control the operation of the power source 110 and the hydraulic pumps 115 based on feedback from the hydraulic control system 170 (which may communicate with the master power and control system 160 over the network) and the various sensors 130, 135, and/or 140. Thus, together the master power and control system 160 and the hydraulic control system 170 are operable to control the entire system 100 in real-time.

Figure 3:
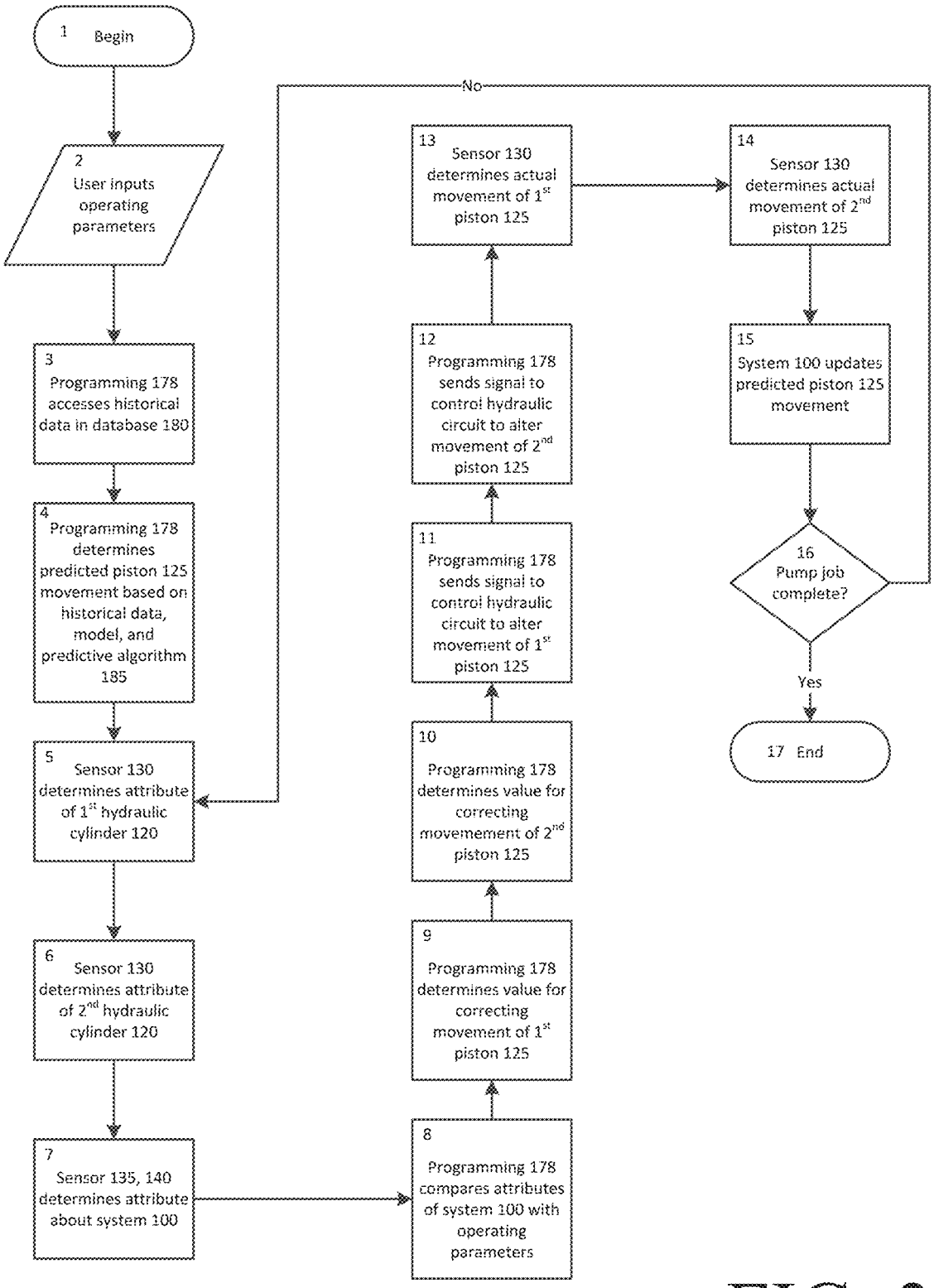
FIG. 3 is an exemplary set of steps performed by the programming of the control module according to an embodiment of the invention.

FIG. 3 illustrates a flow chart of an exemplary set of steps performed by the programming 178 according to one embodiment of the invention. The process begins at step 1. At step 2, a user inputs operating parameters associated with the system 100. For example, the user may input desired output pressures of the fluid from the fluid end 145, maximum operating pressures, maximum rate of piston acceleration, and/or other parameters. The user may engage with the input/output device 182 of the control module 172 (and it shall be understood that while the input/output device 182 is shown as being integral to the control module 172, it may be separate from but in communication with the control module 172, such as a mobile device). Moving on, at step 3, the programming 178 accesses historical data stored in the database 180, if there is such information available. At step 4, the programming 178 determines predicted piston 125 movement based on the historical data (if any) retrieved at step 3, the model, a predictive algorithm 185, and the desired operating parameters input by the user at step 2.

The pump system is engaged, and at step 5, a sensor 130 determines an attribute of a first hydraulic cylinder 120 (or group of cylinders 120). The attribute may be the speed of the piston 125, for example. Similarly, at step 6, a sensor 130 determines an attribute of a second hydraulic cylinder 120 (or group of cylinders 120). Again, the attribute may be the speed of the piston 125, although other attributes may be measured or determined as well. Skilled artisans shall understand that the system is not limited to measuring and controlling two hydraulic cylinders (or groups of cylinders).

As noted herein, sensors 135, 140 may also be distributed throughout the system 100 to measure various attributes about the system 1—as a whole. Accordingly, at step 7, one or more sensors 135, 140 determines an attribute about the system 100, such as the pressure or flow rate of the fluid coming out of the fluid end 145, or the amplitude and frequency of vibrations throughout the low-pressure and high-pressure conduit system 152. Once the various sensor data has been collected, the process moves to step 8.

At step 8, the programming 178 compares the attributes of the hydraulic cylinders 120 and the system 100 with the operating parameters entered at step 2. Upon comparing the data points, at step 9 the programming 178 determines a value for correcting movement of the first piston 125 in order to alter the function of the pump to better service the hydraulic fracturing operation. For example, the system attribute may determine that the conduit system 152 is vibrating in such a way that may be harmful to the system 100. Accordingly, at step 9 the programming 178 may determine that the first hydraulic cylinder 120 needs to alter movement of the piston 125 in such a way that the vibrations may be reduced or eliminated. This may include slowing down (or speeding up) the rate of acceleration of the piston 125 of the first hydraulic cylinder 120, for example.

As described above, the first hydraulic cylinder 120 does not necessarily operate independently of the other hydraulic cylinders 120 forming part of the system 100. Accordingly, at step 10, the programming 178 determines a calculated movement of the second piston 125 of the second hydraulic cylinder 120 in order to alter the function of the pump to better service the hydraulic fracturing operation. The calculated movement of the first piston 125 from step 9 may be taken into account when determining the altered movement of the second piston 125. While the first and second hydraulic cylinders 120 may be independently controlled, the pistons 125 must work in conjunction to ensure safe and efficient operation of the system 100.

Moving on, at steps 11 and 12, the programming 178 sends a signal to the respective hydraulic circuits of the first and second hydraulic cylinders 120 to effectuate the altered movements of the pistons 125 as determined in steps 9 and 10. The calculated corrected movements of the first and second pistons 125 may not be fully accomplished by the hydraulic cylinders 120 due to inevitable inefficiencies within the system 100. Accordingly, in order to determine the degree to which the altered movements affect the output of the system 100, one or more sensors 130 determine the actual movement of the first piston 125 at step 13. Likewise, at step 14, one or more sensors 130 determine the actual movement of the second piston 125. This information may be utilized by the programming 178 to update predicted piston 125 movement of the system 100 going forward at step 15. If the pump job is not complete, as determined at step 16, then the system 100 returns to step 5, where attributes of the hydraulic cylinders 120 are determined. The updated the predicted piston 125 movement from step 15 may be utilized to inform the programming 178 about the historical functioning of the cylinders. If the pump job is complete, then the process ends at step 17.

At all times throughout the process, various data gathered from the various sensors 130, 135, 140 may be stored in the database 180 and accessed by the programming 178 to make the determinations necessary to operate the system 100. While many different attributes, measurements, and alterations can be determined, and are considered within the scope of this disclosure, certain parameters may be considered of utmost importance for measurement and adjustment. In embodiments, it may be crucial for the system 100 to determine the exact point in time when the piston 125 must be stopped in order to avoid damage, or to bottom out a mechanical face, and to ensure that the hydraulic circuit controls fluid pressure to the piston 125 in such a way that damage is avoided. Similarly, it may be necessary to determine when the direction of motion must be reversed, and to take the steps necessary to ensure that the adjustment takes place. Other important parameters which may be measured and adjusted include the force applied when the piston 125 is in motion, the acceleration of the piston 125 as it reaches rate, the period of pressure, the deceleration of the piston 125 as the system 100 is shut down, and the degree of offset of one piston 125 in view of another.

Figure 4:
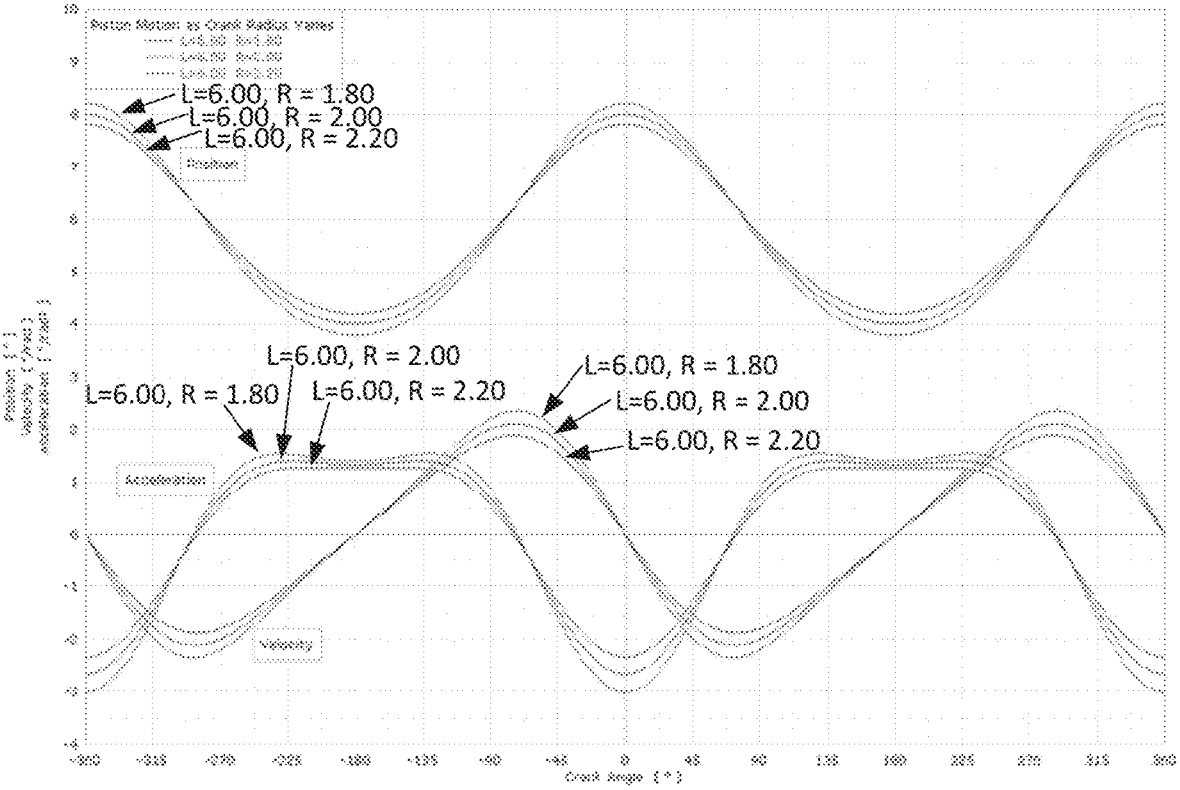
FIG. 4 is a graphical illustration of a prior art mechanically driven fracturing pump system.
Figure 5:
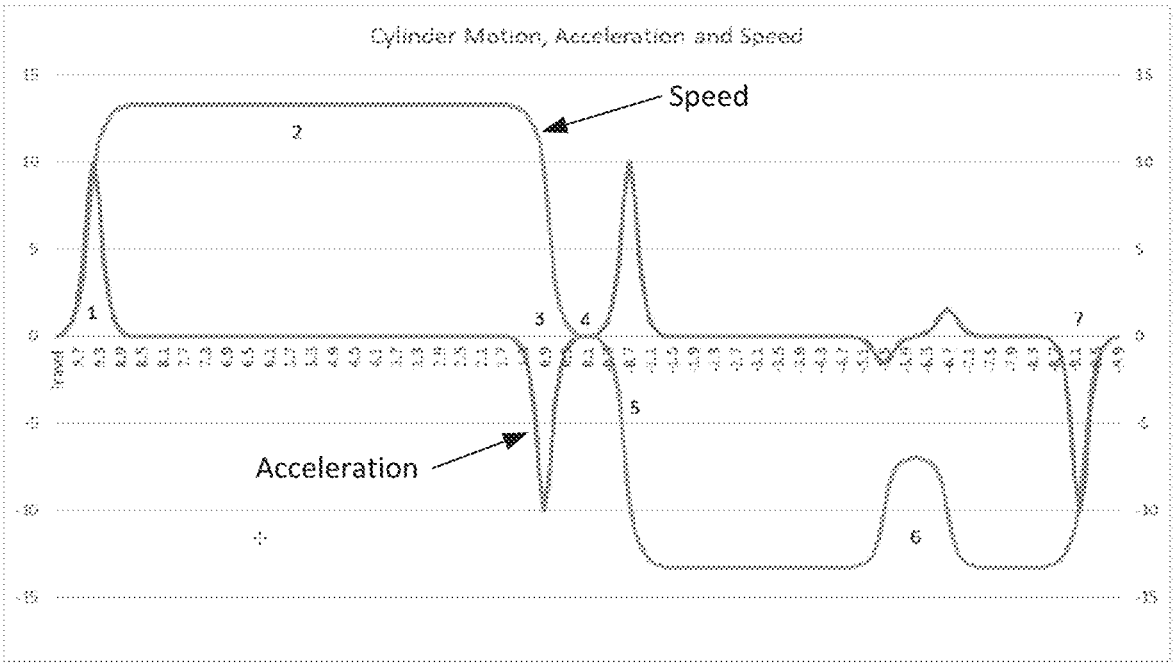
FIG. 5 is a graphical illustration of a hydraulically driven fracturing pump system according to embodiments of the invention.

Moving on, FIGS. 4 and 5 are graphical illustrations of cylinder motion in a mechanically driven and a hydraulically driven fracturing pump system, respectively. In FIG. 4, the motion of the cylinder is based on a rotating crank in the power end that converts rotational motion to reciprocating motion. The speed, position, acceleration and velocity of the piston movement is dependent on the crank radius and the angle. Conversely, in FIG. 5, the motion of the piston is based on the motion of the hydraulic cylinder. There is no dependency on radius or angle. Accordingly, the speed and acceleration may be controlled by historical data, models, algorithms, sensors, and computers in a dynamic relationship with each other. In FIG. 5, points 1, 3, 5, and 7 on the graph illustrates acceleration and deceleration of the piston, which can be modified based on various requirements of the system. At point 2, the speed can be maintained for a period of time with virtually no degree of variability due to mechanical affects, which was virtually impossible with prior art systems. Finally, at point 6, the speed can be optionally intentionally varied mid-stroke as needed by the system. Again, this was effectively unfeasible according to mechanically driven systems. The ability to control the speed and acceleration of the piston using hydraulic pumps in real time communication with various subsystems within the overall system thus allows for more controlled, reliable, and efficient operation.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

The invention claimed is:

1. An automatically controlled hydraulic fracturing pump system, comprising:

at least one hydraulic cylinder comprising a piston controlled via a hydraulic circuit;

at least one sensor in communication with each hydraulic circuit; and a control module in data communication with the at least one sensor, the control module comprising:

a memory storing computer-readable instructions; and a processor configured to execute said instructions to:

(1) determine, via the at least one sensor, at least one attribute about the at least one hydraulic cylinder;

(2) determine a plurality of attributes about the hydraulic fracturing pump system, wherein the plurality of attributes about the hydraulic fracturing pump system comprise one or more pressures, one or more vibrations, and one or more flow rates;

(3) select at least one hydraulic cylinder attribute and at least one hydraulic fracturing pump system attribute as a basis of optimization, wherein the selected attributes are chosen as a basis of optimization, from among all measured attributes, in order to optimize hydraulic fracturing operations in real time;

(4) determine a value for adjusting movement of at least one piston based on the at least one selected attribute about the hydraulic cylinder and the at least one selected attribute about the hydraulic fracturing pump system; and (5) send a signal to the at least one hydraulic circuit to adjust movement of the at least one piston based on the value from step (4), wherein the adjustment includes imparting a corrective pressure on the at least one piston, the corrective pressure being operable to reverse piston motion at an exact location such that:

piston efficiency is increased, where each piston spends a majority of its operational time in a speed region of motion; and pulsation events are introduced in each piston at specific timings, in order to negate unwanted component vibrations and prevent damage to the overall system from resonant and harmonic effects.

2. The system of claim 1, wherein the value for adjusting movement of the the at least one piston is further based on historical operational data about the at least one hydraulic cylinder, the historical data being stored in the memory and accessible via the processor.

3. The system of claim 1, wherein the at least one hydraulic cylinder comprises a first hydraulic cylinder, a second hydraulic cylinder, and a third hydraulic cylinder operable in a triplex pump configuration.

4. The system of claim 3, wherein the at least one attribute of the at least one hydraulic cylinder is determined for each of the first hydraulic cylinder, the second hydraulic cylinder, and the third hydraulic cylinder.

5. The system of claim 4, wherein the at least one attribute of each of the respective hydraulic cylinders is the respective position of the piston of each hydraulic cylinder.

6. An automatically controlled hydraulic fracturing pump system, comprising:

a first hydraulic cylinder having a piston controlled via a first hydraulic circuit;

a second hydraulic cylinder having a piston controlled via a second hydraulic circuit;

a first sensor in communication with the first hydraulic circuit;

a second sensor in communication with the second hydraulic circuit; and a control module in data communication with each sensor, the control module comprising:

a memory storing computer-readable instructions; and a processor configured to execute said instructions to:

(1) determine at least one attribute about the first hydraulic cylinder piston via the first sensor;

(2) determine at least one attribute about the second hydraulic cylinder piston via the second sensor;

(3) determine a plurality of attributes about the hydraulic fracturing pump system, wherein the plurality of attributes about the hydraulic fracturing pump system comprise one or more pressures, one or more vibrations, and one or more flow rates;

(4) select at least one first hydraulic cylinder attribute, at least one second hydraulic cylinder attribute, and at least one hydraulic fracturing pump system attribute as a basis of optimization, wherein the selected attributes of the first hydraulic cylinder, second hydraulic cylinder, and the hydraulic fracturing pump system are chosen, from among all measured attributes, as a basis of optimization in order to best improve hydraulic fracturing operations in real time;

(5) determine a first value for adjusting movement of the first hydraulic cylinder piston based on the at least one selected attribute about the hydraulic fracturing pump system;

(6) determine a second value for adjusting movement of the second hydraulic cylinder piston based on the at least one selected attribute about the hydraulic fracturing pump system;

(7) send a signal to the first hydraulic circuit to adjust movement of the first hydraulic cylinder piston based on the first value, wherein the adjustment includes imparting a corrective pressure on the first hydraulic cylinder piston, the corrective pressure being operable to reverse the piston motion at an exact location; and (8) send a signal to the second hydraulic circuit to adjust movement of the second hydraulic cylinder piston based on the second value, wherein the adjustment includes imparting a corrective pressure on the second hydraulic cylinder piston, the corrective pressure being operable to reverse the piston motion at an exact location;

wherein the first hydraulic cylinder and the second hydraulic cylinder are independently controlled via the respective hydraulic circuits, and wherein the corrective pressure of the first and second cylinders reverse each cylinder's respective piston motions such that:

piston efficiency is increased, where each piston spends a majority of its operational time in a speed region of motion; and pulsation events are introduced in each piston at specific timings, in order to negate unwanted component vibrations and prevent damage to the overall system from resonant and harmonic effects.

7. The system of claim 6, wherein the respective value for adjusting movement of the respective piston is further based on historical operational data about the respective hydraulic cylinder, the historical data being stored in the memory and accessible via the processor.

8. The system of claim 6, wherein the at least one attribute of each of the respective hydraulic cylinders is the respective position of the piston of each hydraulic cylinder.

9. The system of claim 8, wherein one of the plurality of determined attributes of the hydraulic fracturing pump system is an output pressure to the wellhead.

10. The system of claim 9, wherein one of the plurality of attributes of the hydraulic fracturing pump system is an amplitude or frequency of a vibration of a conduit forming a part of the hydraulic fracturing pump system.

11. The system of claim 9, wherein the corrected movement of the first hydraulic cylinder piston comprises correcting the position of the first hydraulic cylinder piston relative to the position of the second hydraulic cylinder piston.

12. The system of claim 11, wherein the corrected movement of the second hydraulic cylinder piston comprises correcting the position of the second hydraulic cylinder piston relative to the corrected position of the first hydraulic cylinder piston.

13. The system of claim 12, wherein one of the plurality of attributes of the hydraulic fracturing pump system is an amplitude and frequency of a vibration of a conduit forming a part of the hydraulic fracturing pump system; and wherein the adjusted position of the first and second hydraulic cylinder pistons is further based on the amplitude and frequency of the vibration of the conduit.

14. The system of claim 6, wherein:

each piston comprises a marking;

the first sensor is configured to read the marking on the first piston and the second sensor is configured to read the marking on the second piston; and the readings from the first and second pistons are used to determine a position of each respective piston.

15. An automatically controlled hydraulic fracturing pump system for a hydraulic fracturing pump job, comprising:

at least one hydraulic cylinder controlled via a hydraulic circuit;

at least one sensor in communication with each hydraulic circuit; and a control module in data communication with the at least one sensor, the control module comprising:

a memory storing computer-readable instructions; and a processor configured to execute said instructions to:

(1) receive operating parameters from a user via an input device;

(2) access historical operation data stored in a database stored in the memory;

(3) determine a pattern of movement of the at least one hydraulic cylinder based on the historical operation data;

(4) determine a predicted cylinder movement for the at least one hydraulic cylinder based on the operating parameters and the pattern of movement;

(5) initiate the predicted cylinder movement of the at least one hydraulic cylinder;

(6) determine, via the at least one sensor, at least one attribute about the predicted cylinder movement of the at least one hydraulic cylinder;

(7) determine a plurality of attributes about the hydraulic fracturing pump system, wherein the plurality of attributes about the hydraulic fracturing pump system comprise one or more pressures, one or more vibrations, and one or more flow rates;

(8) select at least one hydraulic fracturing pump system attribute as a basis of optimization, wherein the at least one selected attribute is chosen as a basis of optimization, from among all measured attributes, in order to best improve hydraulic fracturing operations in real time;

(9) compare the at least one selected attribute of the hydraulic fracturing pump system from step (8) with the operating parameters;

(10) determine a value for correcting movement of the at least one hydraulic cylinder;

(11) send a signal to the at least one hydraulic circuit to initiate correcting movements of the at least one hydraulic cylinder, wherein correcting the movements includes imparting a corrective pressure on the hydraulic cylinder, the corrective pressure being operable to reverse the movement of the hydraulic cylinder at an exact location such that:

piston efficiency is increased, where each piston spends a majority of its operational time in a speed region of motion; and pulsation events are introduced in each piston at specific timings, in order to negate unwanted component vibrations and prevent damage to the overall system from resonant and harmonic effects;

(12) determine an actual corrected movement of the at least one hydraulic cylinder via the at least one sensor;

(13) update the historical operation data based on the actual corrected movement; and

(14) repeat steps 7 through 13 until the hydraulic fracturing pump job is complete.

16. The system of claim 15, wherein the predicted cylinder movements of the at least one hydraulic cylinder comprises stopping a movement of the at least one hydraulic cylinder in a first direction and initiating a movement of the at least one hydraulic cylinder in a second opposing direction.

17. The system of claim 16, further comprising compensating for system inertia in the movement of the at least one hydraulic cylinder in the first direction at the time of initiating the predicted cylinder movement by imparting a corrective pressure on the at least one hydraulic cylinder, wherein the corrective pressure on the at least one hydraulic cylinder causes the at least one hydraulic cylinder to exactly stop at a predetermined location.

* * * * *